United States Patent [19]

Dunmore

[11] Patent Number: 4,800,988

[45] Date of Patent: Jan. 31, 1989

[54] ADJUSTABLE PLATFORM FOR A RUNG LADDER

[76] Inventor: Joseph Dunmore, 13 Sandringham Road, Liverpool, United Kingdom, L13 8BX

[21] Appl. No.: 181,520

[22] Filed: Apr. 14, 1988

[51] Int. Cl.[4] ..... E06C 1/38

[52] U.S. Cl. ..... 182/103; 182/120

[58] Field of Search ..... 182/103, 102, 120, 121, 182/122, 45; 187/10, 9 R

[56] References Cited

U.S. PATENT DOCUMENTS

| | | | |
|---|---|---|---|
| 107,225 | 9/1870 | Claflin | 182/103 |
| 444,280 | 1/1891 | Pepin | 182/103 |
| 683,890 | 10/1901 | Wolfe | 182/103 |
| 715,944 | 12/1902 | Bauer | 182/103 |
| 767,388 | 8/1904 | Cirigliano | 182/103 |
| 788,992 | 5/1905 | Bauer | 182/103 |
| 2,148,958 | 2/1939 | Myers | 182/120 |
| 2,588,959 | 3/1952 | Campbell | 182/103 |

*Primary Examiner*—Reinaldo P. Machado

*Attorney, Agent, or Firm*—John C. Cooper, III; C. Thomas Sylke; Fred Wiviott

[57] ABSTRACT

An adjustable platform for a rung ladder has a footplate which provides sufficient surface area to enable full contact by the users feet. A footplate support system enables the footplate to accomodate a range of angles of inclination of the ladder relative to the horizontal. The footplate support system is releasably secured to two parallel guides running length wise of the ladder, either as part of extruded ladder stiles or secured to stiles of an existing ladder, and is adapted to slide up and down the guides to engage the footplate with the desired rung of the ladder. Clamp means is provided to locate the footplate in the desired position.

12 Claims, 2 Drawing Sheets

ADJUSTABLE PLATFORM FOR A RUNG LADDER

BACKGROUND OF THE INVENTION

1. Field of the Invention

This invention relates to an adjustable platform for a rung ladder.

Conventional rung ladders have a plurality of narrow parallel struts, generally of cylindrical form, which enable the ladder to be scaled when supported against the wall of a building for example. These rungs however, by virtue of their narrow form, tend to give rise to bodily discomfort if it is necessary to stand on the rungs for a prolonged period, also the small area of contact between the rungs and the users feet induce nervousness in some people.

It is an aim of the present invention to provide a platform for use with a rung ladder to avoid the aforementioned problem. As a ladder may be used at a range of inclinations to the horizontal, it is a further aim to provide a platform which can be positioned horizontally for that range of inclinations. A still further aim is to be able to locate the platform adjustably along the length of the ladder.

Accordingly the present invention provides an adjustable platform for a rung ladder comprising guides, a footplate and a footplate support system. Means is preferably provided for the footplate to releasably engage a rung of the ladder, and means is provided for clamping the footplate in a desired position. Conveniently, the clamping means comprises sliding clamping block slidably received in the guides and clamping units.

Two parallel guides are preferably provided and running lengthwise of the ladder, and may be purpose formed extrusions serving as styles for the ladder. Alternatively the guides may be configured to adapt an existing ladder, for example as extrusions to be bolted to styles.

To enable the angle of the footplate relative to the ladder to be varied in order to accommodate a range of angles of inclination of the ladder to the horizontal the footplate is movble relative to a position of the footplate support system. More particularly, the footplate is pivotably secured to a pair of support arms by way of pivot blocks. The support arms are pivotably secured at their other ends to the aforementioned sliding clamping blocks. A further pivotal connection of the footplate to the guide is preferably provided by way of two sliding blocks each received slidably in a respective one of the guides, and pivotably connected to respective associated pivot block carried by the footplate.

On an adjustable platform manufactured for an existing ladder means is provided for adjusting the footplate support system to suit ladders of different widths. Conveniently such adjustment may be effected by arranging for the aforementioned pivot blocks to be adjustably laterally by way of tee bolts and tee bolt guides.

DESCRIPTION OF THE DRAWINGS

The present invention will now be described further, by way of example only, with reference to the accompanying drawings in which.

DESCRIPTION OF THE PREFERRED EMBODIMENT

Figure 1:
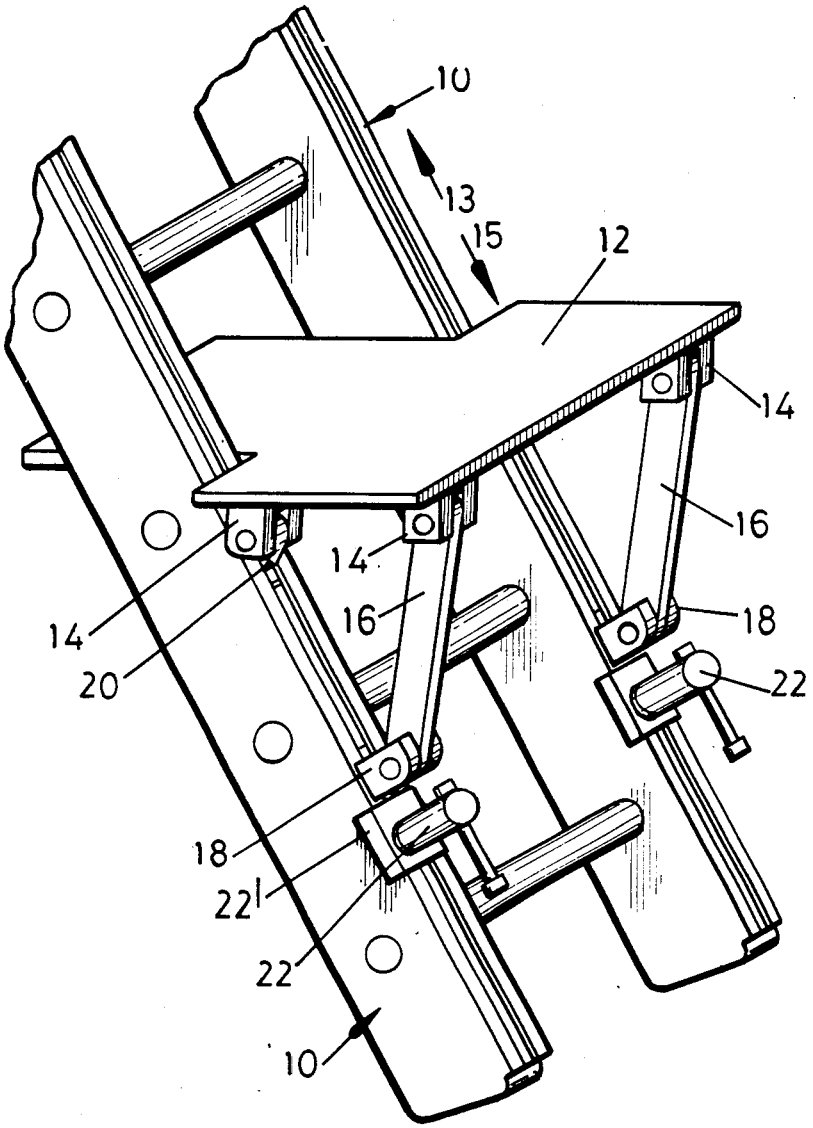
FIG. 1 shows a fragmentary perspective view of a platform in position on a rung ladder.
Figure 2:
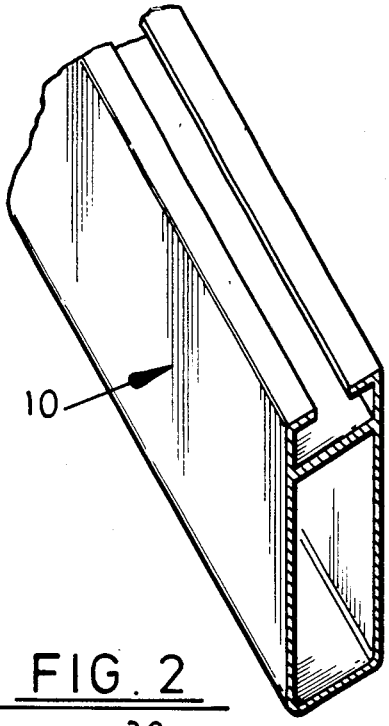
FIG. 2 shows in sectional view a ladder side with a guide for housing sliding pivot blocks and sliding clamping blocks of a footplate support system.
Figure 3:
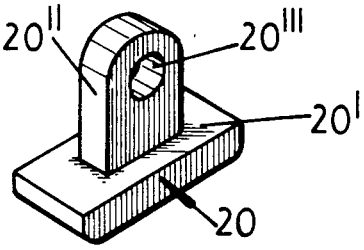
FIG. 3 shows in perspective a sliding pivot block.
Figure 4:
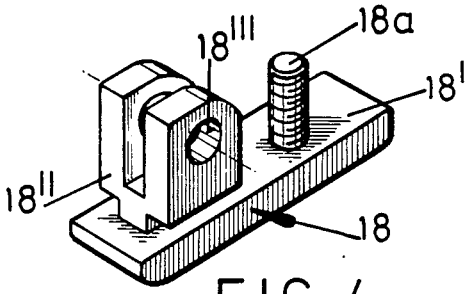
FIG. 4 shows in perspective a sliding clamping block.
Figure 5:
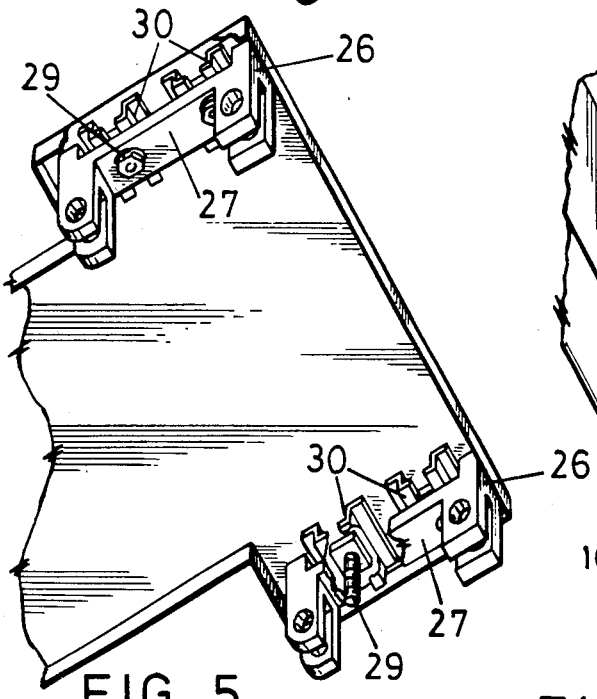
FIG. 5 shows in perspective the underside of footplate for an existing ladder with an arrangement for adjusting pivot blocks to suit ladders of various widths.

Referring now to the drawings, there is shown a rung ladder having a pair of guides 10 which in the embodiment of FIG. 1 are incorporated in the extruded sides of the ladder (see FIG. 2). A footplate 12 is adjustably positionable along the length of the ladder by way of a footplate support system which engages cooperatingly with the guides. The footplate carries two pairs of pivot blocks 14. A first pair of the pivot blocks (14) are journalled to respective sliding pivot blocks 20 (illustrated in FIG. 3) which are received retainingly but slidably longitudinally in a respective one of the guides 10. Each sliding pivot block 20 has a body 20' which is received in a groove of the guide 10 and lug 20'' which projects from a slot of the guides. The guide has a bore 20''' to receive a pin connecting it pivotably to the pivot block 14. A second pair of the pivot blocks 14 (referred to as rear pivot blocks) receive pivotally an upper end of respective support arms 16 whose lower ends are journalled pivotably in sliding clampinng blocks 18 (illustrated in FIG. 4) which are received retainingly but slidably longitudinally in a respective one of the guides 10. Each sliding clamping block 18 has a body 18' received in the guide 10 and an upstanding lug 18'' dimensioned to pass through the slot of the guide. The lug is bifurcated in the illustration and has bore 18'' to receive a pin to connect the support arm 16 pivotally thereto. An upstanding threaded stud **18*a* is secured to the body 18'' to be engaged by a clamping unit 22. A respective said clamping unit 22 is provided to locate the associated sliding clamping block 18 with respect to the guide 10. The clamping unit draws the sliding clamping block into engagement with the sloted guide. A reaction plate is illustrated at 22'**.

The sliding pivot blocks 20 and the sliding clamping block 18 allow movement of the platform to a desired position along the length of the ladder.

The connection of the footplate 12 to the guides 10 by way of the cooperating pivot block 14 and sliding pivot blocks 20 allows positioning of the footplate with respect to the guides so that it can be brought into engagement with a rung of the ladder then serving as an abutment for the footplate, which is further supported by the support arms when the clamping units are done-up. The above described footplate support system enables the angle of the footplate relative to the ladder to be raised in order to accommodate a range of angles of inclination of the ladder with the aim being to have the footplate horizontal in use.

In order to engage the footplate with the desired rung of the ladder, the clamping unit 22 is released and drawn towards the foot of the ladder in the direction of arrow 15, the footplate pivots about the sliding pivot blocks 20 into a position parallel to the guides, the platform is then pushed in the direction of arrow 13 or arrow 15 until the front of the footplate is in a position between the desired rung and the rung above it, the footplate is then pivoted about sliding pivot blocks 20 until the underside of the footplate engages with the desired rung. The sliding clamping blocks 18 are then positioned to bring the footplate parallel to the ground, the clamping unit is then tightened to secure the platform in position.

After use, the platform is positioned at the foot of the ladder with the footplate in a position parallel to the guides and secured with the clamping unit.

Figure 6:
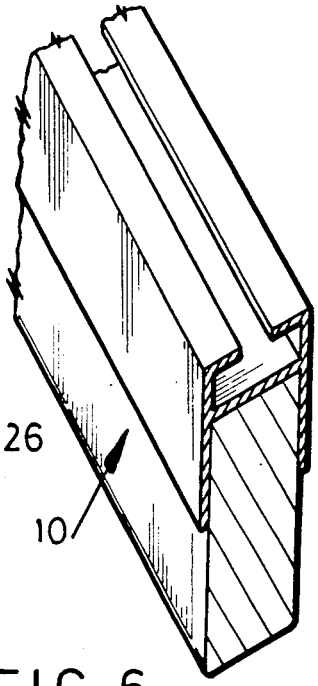
FIG. 6 shows in perspective a guide positioned on an existing ladder side.

In order to provide a platform for use with an existing ladder, bolt on guides are provided, for example as shown at 28 in FIG. 6 with the guides 28 fitting over the stiles 28' of the ladder—not illustrated in further detail. As with the guide 10 of FIG. 1, the guide 28 provides a slotted groove to receive the sliding pivot blocks 20 and the sliding clamping blocks 18 with the connection parts projecting through the slot. To accommodate different widths of ladder, the pivot blocks 26 are mounted adjustably width wise. For this purpose pivot blocks 26 are formed as part of a mounting member 27 which is secured to the footplate by way of T-headed bolts 29 received in slotted carriers 30. The common mounting of the pivot blocks 26 for each side of the ladder is preferred to ensure ease of alignment for sliding, but individual mounting and adjustment is an alternative.

What is claimed is:

1. An adjustable platform for a rung ladder comprising two parallel guides running lengthwise of the ladder, a footplate engagable with a selected rung of the ladder, and footplate support system adapted to slide in the guides for adjusting the angle of the footplate relative to the guides, and means for clamping the footplate in a desired position.

2. An adjustable platform according to claim 1 in which the footplate is movable between a working position angled relative to the ladder and a storage position generally parallel to the ladder.

3. An adjustable platform according to claim 1 wherein the means for clamping the footplate comprises sliding clamping blocks and clamping units.

4. An adjustable platform according to claim 1 comprising means releasably securing the footplate and footplate support system to the guides.

5. An adjustable platform according to claim 4 in which said means comprises sliding blocks and sliding clamping blocks.

6. An adjustable platform according to claim 1 in which the footplate support system comprises two sliding clamping blocks received slidably in a respective one of the guides, a pair of support arms each pivotally secured at one end to the footplate and at their other end to a respective one of the two sliding clamping blocks.

7. An adjustable platform according to claim 6 comprising two pivot blocks carried by the footplate and to which the support arms are pivotably secured to the footplate.

8. An adjustable platform according to claim 1 in which the footplate support system comprises two sliding blocks received slidably in a respective one of the guides, and two pivot blocks carried by the footplate and secured pivotably to a respective sliding block to facilitate sliding of the footplate along the guides and pivotal movement of the footplate to be engagable with a rung of the ladder.

9. An adjustable platform according to claim 1 wherein the guides are adapted for securing to stiles of an existing ladder.

10. An adjustable platform according to claim 1 comprising means for adjusting the width of the footplate support system to suit ladders of varying widths.

11. An adjustable platform according to claim 10 wherein said means comprises pivot blocks carried laterally adjustably by the footplate by means of tee bolts and tee bolt guides.

12. An adjustable platform according to claim 1 in which the guides are formed integrally with stiles of a rung ladder.

* * * * *